US008156577B1

(12) United States Patent
Teague

(10) Patent No.: US 8,156,577 B1
(45) Date of Patent: Apr. 17, 2012

(54) AERATED BATHROOM FIXTURE

(76) Inventor: Timothy Teague, Stanwood, WA (US)

( * ) Notice: Subject to any disclaimer, the term of this patent is extended or adjusted under 35 U.S.C. 154(b) by 3 days.

(21) Appl. No.: 12/938,614

(22) Filed: Nov. 3, 2010

Related U.S. Application Data

(60) Provisional application No. 61/257,740, filed on Nov. 3, 2009.

(51) Int. Cl.
*E03D 9/00* (2006.01)
*F15D 1/00* (2006.01)

(52) U.S. Cl. ..... 4/300.3

(58) Field of Classification Search ..... 4/300.3, 4/300, 222, 309–311, 213, 449, 661, 420; 251/129.15, 129.04; *E03D 9/00; F15D 1/00*
See application file for complete search history.

(56) References Cited

U.S. PATENT DOCUMENTS 4,571,752 A * 2/1986 Bick ..... 4/300
4,866,793 A * 9/1989 Luedtke et al. ..... 4/300.3
5,054,136 A * 10/1991 Inagaki ..... 4/546
5,647,074 A * 7/1997 White et al. ..... 4/664
5,842,237 A * 12/1998 Hargest et al. ..... 4/449
6,009,570 A * 1/2000 Hargest et al. ..... 4/449
7,156,363 B2 * 1/2007 Parsons et al. ..... 251/30.04
7,316,038 B2 * 1/2008 Egeresi ..... 4/420.4
7,437,778 B2 * 10/2008 Parsons et al. ..... 4/249
8,042,202 B2 * 10/2011 Parsons et al. ..... 4/623
2002/0194670 A1 * 12/2002 Hashemi ..... 4/213
2004/0064884 A1 * 4/2004 Egeresi ..... 4/661
2006/0230525 A1 * 10/2006 Joseph ..... 4/661
2007/0200078 A1 * 8/2007 Parsons et al. ..... 251/129.04
2009/0121171 A1 * 5/2009 Parsons et al. ..... 251/129.15

* cited by examiner

*Primary Examiner* — Lori Baker
(74) *Attorney, Agent, or Firm* — Dwayne E. Rogge; Hughes Law Firm, PLLC

(57) ABSTRACT

Disclosed herein is a novel feature of a toilet for reducing the density of the fluid in the bottom portion of a bathroom fixture to eliminate spray when desired. When not desired, for example, when a user is seated upon the bathroom fixture, this feature may be deactivated. In one form, when the anti-spray feature is turned off, the bubbles will have substantially disappeared in less than a few seconds. The bathroom fixture (toilet) is provided with an air source, such as an air pump, compressed air cylinder, or compressor, coupled by way of an air line or hose to an air diffuser chamber. When the air source is activated, a substantial portion of the water in the air diffuser chamber will be displaced by the air provided by the air source. The vertical region of bubbles within the standing water reduces the density of the water in that region, such that splash is virtually eliminated.

11 Claims, 5 Drawing Sheets

AERATED BATHROOM FIXTURE

RELATED APPLICATIONS

This application claims priority benefit of U.S. Ser. No. 61/257,740, filed Nov. 3, 2009.

BACKGROUND OF THE DISCLOSURE a) Field of the Disclosure

This disclosure relates to the field of improved bathroom fixtures, particularly toilets and urinals. The improvement is configured to reduce splash effects, among other desired outcomes.

DESCRIPTION OF THE PREFERRED EMBODIMENTS

Figure 1:
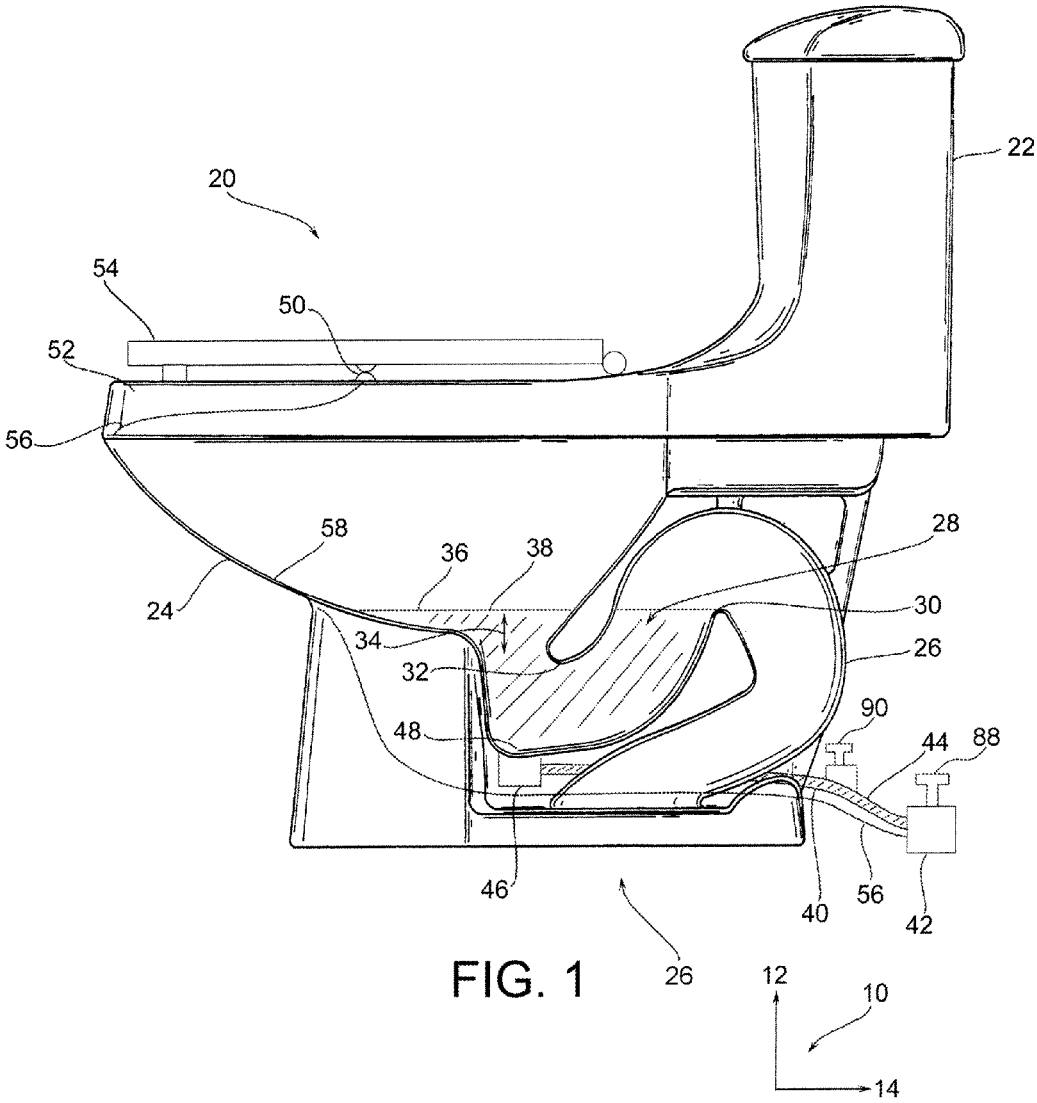
FIG. 1 is a side cutaway view of an improved bathroom fixture, in one form.
Figure 2:
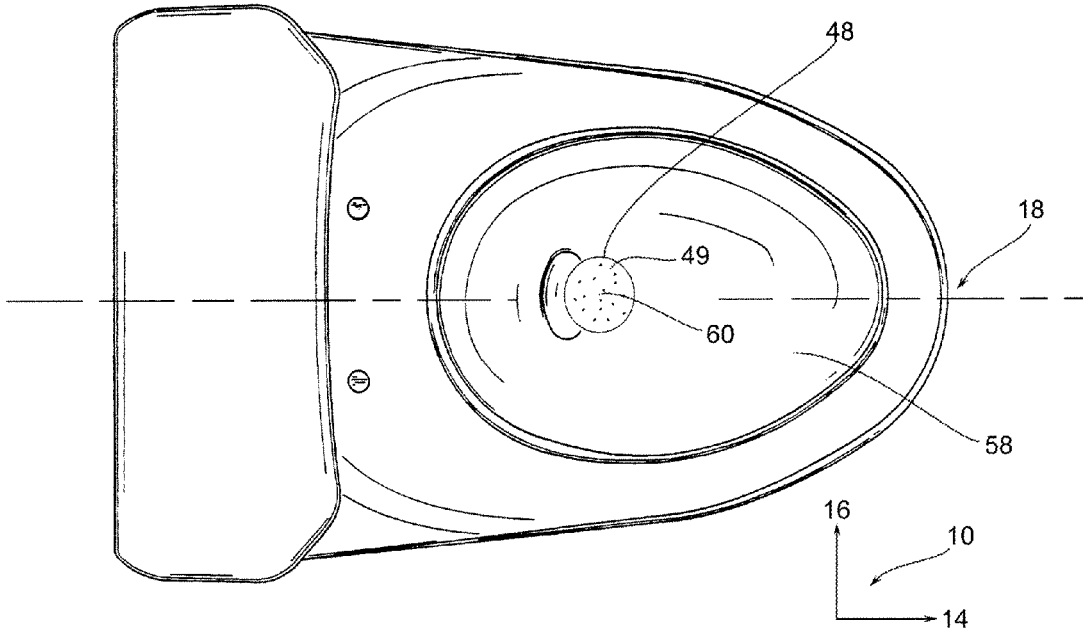
FIG. 2 is a top view of the improved bathroom fixture of FIG. 1, in one form.

Before beginning, an axis system 10 is shown in FIG. 1 comprising a vertical axis 12 and a longitudinal axis 14. Continuing to FIG. 2, the axis system 10 is shown with the longitudinal axis 14 and a transverse axis 16. For further ease of understanding, a transverse centerline 18 is shown in FIG. 2. Please note that these axes are intended to aid in understanding of the various embodiments, and are not intended to be limiting.

Looking back to FIG. 1, a bathroom fixture 20 is shown, in one form, as a flush toilet. Within this disclosure, the term "bathroom fixture" is directed to fixtures commonly known as toilets, urinals, and equivalents. Generally, these bathroom fixtures comprise a tank 22 physically and fluidly coupled to a bowl 24. As is well known in the art, a drain 26 is provided to allow for removal of waste. The drain 26 is normally a flush-type drain comprising a trap 28 formed in the drain 26, which generally comprises an overflow weir 30 and an underflow weir 32. The vertical separation between the overflow weir 30 and underflow weir 32 provides a water seal 34. This water seal 34 extends between the normal upper surface 36 of the standing water 38 and the lowermost portion of the underflow weir 32. This water seal 34 provides a barrier for odors between the outflow 40 of the drain 26 and the bowl 24. Thus, the water seal 34 greatly assists in blocking odors from the drain, as is well known in the art.

As is also well known in the art, a fluid stream, or droplets of fluid impacting standing water, will create a splash effect. Stop-action photography of droplets and streams of fluid impacting milk have shown this phenomenon very well. There have been several novel attempts to counteract such splash in toilets, with varying degrees of success. US patent application 2006/0230525 discloses a method and apparatus to reduce toilet splash using water currents and turbulence. It is not clearly defined whether this will actually work, however, it is quite clear that the inventor intended to inject water into the lowermost portion of the toilet bowl to generate water currents in the upper surface of the standing water to deflect said splash. Any gas created is specifically designed to exit via the drain pipe, rather than to "bubble out" back into the open portion of the toilet bowl, as defined in this disclosure. Another reference, U.S. Pat. No. 4,571,752, discloses a toilet incorporating an air supply portion 19, which provides pressurized air into the water and a surfactant to provide a foam layer above the upper surface of the standing water to deflect spray. It is disclosed that "the foam is constantly maintained," and this is accomplished by a relay 50, which provides a sequence of intermittent operating. Several different foam-type systems have been designed; however, the foam often does not completely flush when the toilet is cycled.

Disclosed herein is a novel feature of a toilet for reducing the density of the fluid in the bottom portion of a bathroom fixture 20 to eliminate splash when desired. When not desired (for example, when a user is seated upon the bathroom fixture 20), this feature may be deactivated. To aid in understanding of this disclosure, the term bubbles will be used to define those air pockets which are lighter than the fluid in which they are presented, and which travel upwards through the fluid (water), where they quickly dissipate. In one form, when the anti-spray feature is turned off, the bubbles will have substantially disappeared in less than a few (three) seconds. The term foam will be used to define the layer of air pockets which tend to rest and remain intact for a time above the layer of fluid (water), as opposed to bubbles, which will not remain intact for any substantial length of time.

To accomplish this feature, the bathroom fixture 20 is shown first in FIG. 1. The bathroom fixture 20 (toilet) is provided with an air source 42, such as an air pump, compressed air cylinder, or compressor, coupled by way of an air line or hose 44 to an air diffuser chamber 46. When the air source 42 is activated, a substantial portion of the water in the air diffuser chamber 46 will be displaced by the air provided by the air source 42. A diffusion grid 48, shown in FIGS. 1 and 2, diffuses the air from a substantially solid stream, which would tend to result in very large bubbles to a plurality of much smaller bubbles, which then propagate through the standing water 38 to the upper surface 36 of the standing water 38. In one form, it may not be desired to have a standing layer of foam above the standing water, as most flush toilets, especially low-volume flush toilets, may not adequately flush and eliminate the foam layer which has possibly been contaminated by waste. Rather, the vertical region of bubbles within the standing water reduces the density of the water in that region, such that splash is virtually eliminated without a layer of foam. By using bubbles rather than a standing layer of foam, a device is conceived which is much more controllable, in that once the air supply is disengaged, there will be no residual effects (foam) within the bowl.

In one form, the volume or pressure of the air may be adjusted. In one form this may be accomplished by way of an adjustment device 88 such as an electric rheostat provided on the air source 42. In another form, a constriction valve 90 may be provided on the air supply line 44.

As disclosed, it may not be desirable to have the bubbles continually form in the standing water. In one form, the bubbles will only be desired when the bathroom fixture 20 is utilized by a standing male user. Thus, it is conceived to provide for a switch 50 coupled between the rim 52 of the bathroom fixture 20 and the toilet seat 54. This switch 50 may be coupled by way of a control line or wire 56, which may run hidden from view within the bathroom fixture 20 to the air source 42. In one example, the wire 56 may be coupled to another switch, relay or similar mechanism (not shown) to control power between a power source, such as household electricity, and the air source or pump 42. Thus, when a male user lifts (rotates upwards) the toilet seat 54, the switch 50 is engaged, activating the air source 42 to energize the device and begin producing bubbles in the standing water 38. This configuration has an added benefit in that small children or other users may desire to lift the lid as it has an interesting effect on the bathroom fixture 20. Any person who has tried to potty-train children understands the benefit of such a device.

In one form, as shown in FIG. 2, the air diffuser grid 48 comprises a removable portion 49, which is substantially a planar device with voids 60 therein. The removable portion 49 is in contact with the inner surface 58 of the toilet bowl 42. As shown in FIG. 2, the air diffuser grid 48 comprises a plurality of surfaces defining voids 60, which, in one form, are each between 1/64" to 1/4" in diameter. These surfaces defining voids 60 extend between the air diffuser chamber 46 and the inner surface of the bowl 58. Testing has shown that a large number of smaller holes, resulting in a large number of small bubbles, can be more effective in some applications than a smaller number of larger holes. In one form, these small bubbles are formed using voids 60 smaller than 1/16 of an inch. In one tested prototype, at least 20 voids were provided, and they formed a sufficient bubble region within the standing water. In another tested prototype, more than 100 voids were provided; this arrangement was also quite effective.

In another embodiment, the air diffuser grid 48 is integral (unitary structure) with the bowl 58.

In one form, the air diffuser grid 48, air diffuser chamber 46, wires 56, air supply lines 44, and other structures are provided outside of the inner surface 58 of the bowl 24. In one form, they are positioned within the outer shell of the bathroom fixture 20 so as not to form regions that will entrap water and/or waste, which could become unsanitary or unpleasing in sight or smell. As shown in FIG. 1, in one form, the air diffuser chamber 46 is provided vertically below the currently designed trap 28 so as not to hinder formal toilet function of the trap.

Figure 3:
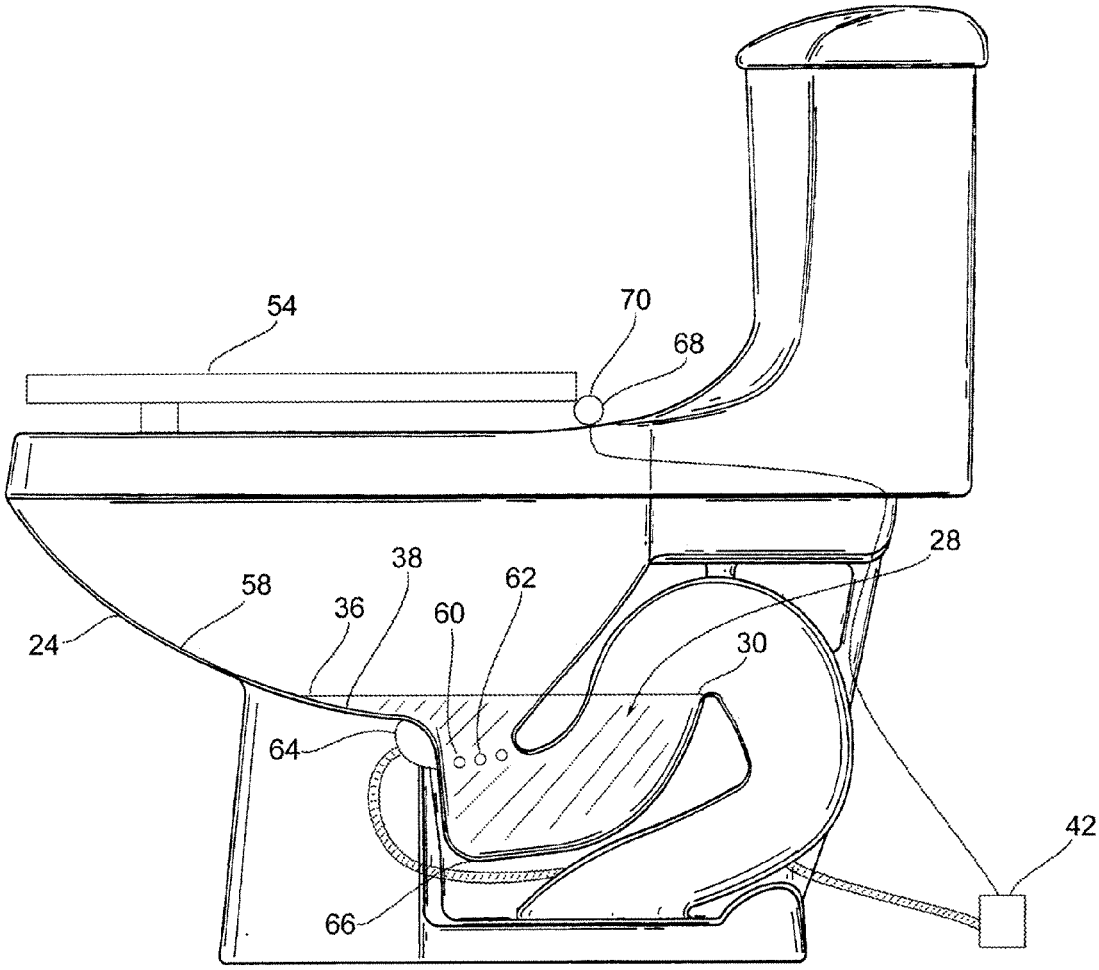
FIG. 3 is a side cutaway view of another improved bathroom fixture, in one form.
Figure 4:
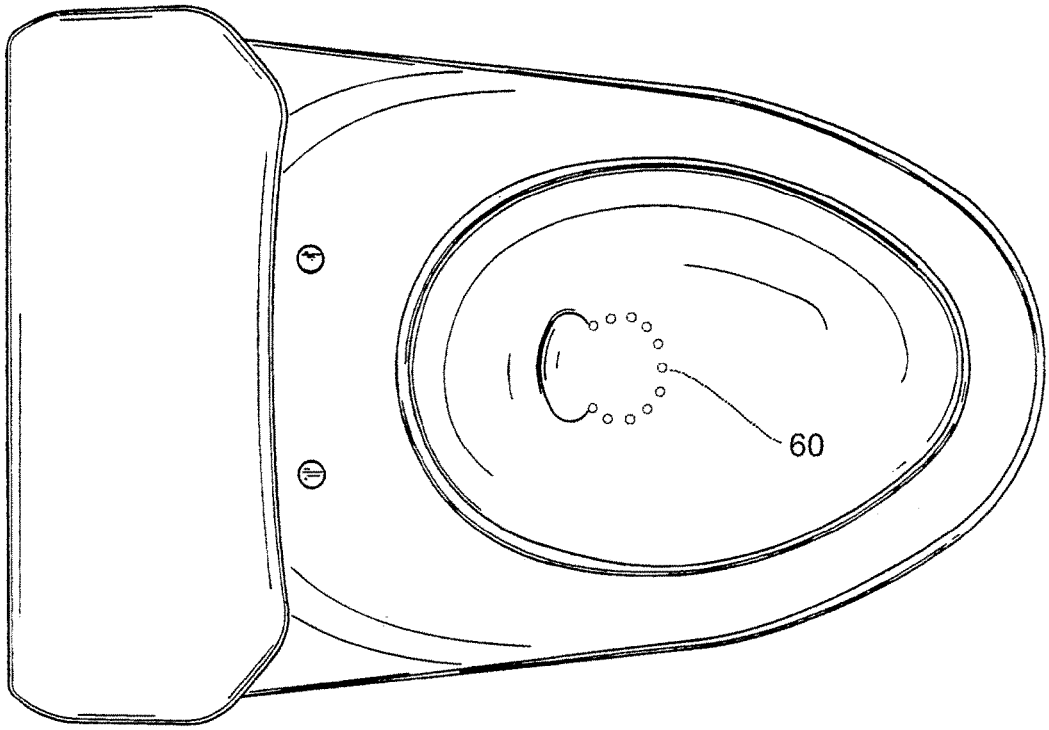
FIG. 4 is a top view of the improved bathroom fixture of FIG. 3, in one form.

Looking now to FIGS. 3 and 4, an embodiment is shown wherein the surfaces defining voids 60 of the air diffuser grid 62 are positioned in a ring-like pattern through the inner surface 58 of the toilet bowl 24, rather than a grid pattern as is shown in FIG. 2. This ring-like pattern, and other patterns, may have specific applications, for example, where it is not possible or undesirable to place the surfaces defining voids 60 at the bottom of the trap 28. Also shown is an air diffuser chamber 64 positioned above the bottommost surface 66 of the trap 28. While only one ring of surfaces defining voids 60 has been shown, other patterns could also be utilized. In one form, it will be desired that the surfaces defining voids 60 be positioned below the uppermost portion of the overflow weir 30, which defines the upper surface 36 of the standing water 38 in most flush toilets. This pattern, as shown in FIG. 4, may have advantages such as not entrapping water or waste within the air diffuser chamber 64, as any fluid and small solid matter within the chamber 64 would be flushed when the bathroom fixture 20 is cycled.

As another alternative, FIG. 3 shows that the air source 42, which provides pressurized air to the diffusion chamber 76, may be operated by a switch 68 provided in the hinge 70 of the toilet seat 54. This configuration may have advantages in specific applications and embodiments. Additionally, standard switches could be incorporated such that a user can activate them at will when air pressure is desired. It is also conceived that a proximity or motion sensor could be utilized.

Figure 5:
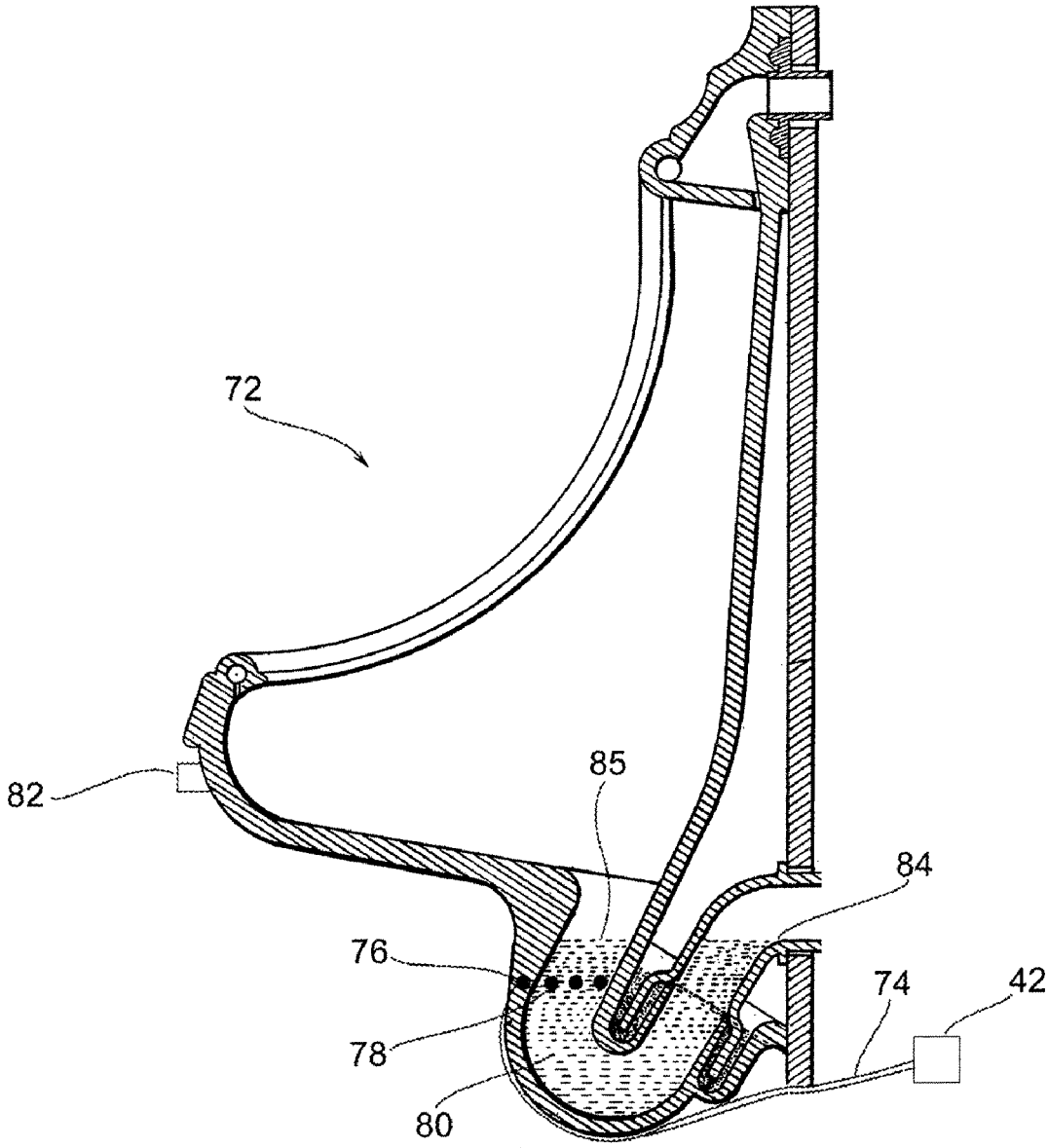
FIG. 5 is a side cutaway view of another improved bathroom fixture, in one form.

In another embodiment, as shown in FIG. 5, the system is utilized within a bathroom fixture 72 such as a urinal. As such, an air source 42 is provided which supplies pressurized air via a hose 74 to a diffusion chamber 76 and to voids 78, which again are provided below the vertical upper edge of the overflow weir 84, which will define the upper surface 85 of the standing water 80. In this embodiment, a proximity switch or motion sensor 82 could be incorporated quite readily, as the user proximal to the urinal is most likely a male user in a standing position and is not likely to be susceptible to the splash effects of the device.

In addition to the other embodiments, chemicals and compounds may be injected upstream from the diffuser grid. Such materials may include air fresheners, colorants, antibacterial agents, antifungal agents, etc.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A bathroom fixture to reduce deflection of urine spray comprising:

a. a bowl having an inner surface operatively configured to hold a volume of standing water;

b. a drain coupled to the bowl further comprising a siphon operatively configured to maintain the volume of standing water;

c. an air diffusion chamber;

d. a diffusion grid comprising a plurality of openings between the air diffusion chamber and the inner surface of the bowl; and e. wherein the diffusion grid is positioned to be below the upper surface of the standing water.

2. The bathroom fixture of claim 1 further comprising:

a. an air source operatively configured to provide pressurized air to the air diffusion chamber at a pressure exceeding 1 atmosphere.

3. The bathroom fixture of claim 2 further comprising an air flow adjustment mechanism which is operably configured to adjust the air flow from the air source to the air diffusion chamber.

4. The bathroom fixture of claim 2 further comprising:

a. a switch coupled to the air source;

b. a toilet seat; and c. wherein the switch is operatively configured to activate the air source when the toilet seat is lifted.

5. The bathroom fixture of claim 4 wherein the switch is positioned between the toilet seat and the rim of the bowl and is operatively configured to detect when the toilet seat is rotated away from the rim of the bowl.

6. The bathroom fixture of claim 4 wherein the switch is positioned at a toilet seat hinge and the switch is operatively configured to detect when the toilet seat is rotated away from the rim of the bowl.

7. The bathroom fixture of claim 2 further comprising:

a. a switch coupled to the air source; and b. wherein the switch is operatively configured to activate the air source when a user is in position to urinate into the bowl.

8. The bathroom fixture of claim 1 wherein the bowl, diffusion chamber, and diffusion grid are a unitary structure.

9. The bathroom fixture of claim 1 wherein the diffusion grid is removable from the bathroom fixture.

10. The bathroom fixture of claim 1 wherein the diffusion grid comprises a plurality of surfaces defining voids though the inner surface of the bowl.

11. The bathroom fixture of claim 1 further comprising:

a. a trap provided in the lowermost portion of the bowl;

b. wherein the trap comprises an overflow weir and an underflow weir; and c. wherein the diffusion grid is positioned above the level of the underflow weir of the trap and below the level of the overflow weir.

* * * * *